US006719639B2

(12) United States Patent
Novosel, Sr.

(10) Patent No.: US 6,719,639 B2
(45) Date of Patent: Apr. 13, 2004

(54) GOLF WRIST TRAINER

(76) Inventor: John Michael Novosel, Sr., 12708 Pembroke La., Leawood, KS (US) 66209

( * ) Notice: Subject to any disclaimer, the term of this patent is extended or adjusted under 35 U.S.C. 154(b) by 79 days.

(21) Appl. No.: 10/166,913

(22) Filed: Jun. 11, 2002

(65) Prior Publication Data

US 2003/0013537 A1 Jan. 16, 2003

Related U.S. Application Data

(60) Provisional application No. 60/297,912, filed on Jun. 13, 2001.

(51) Int. Cl.[7] ..... A63B 57/00; A63B 69/36

(52) U.S. Cl. ..... 473/213; 473/227; 434/252

(58) Field of Search ..... 434/258, 252, 434/247, 392; D21/791; 473/276, 266, 212, 213, 214, 227, 226

(56) References Cited

U.S. PATENT DOCUMENTS 2,703,082 A * 3/1955 Emert ..... 473/213
3,861,688 A * 1/1975 Butler ..... 473/214
3,918,721 A 11/1975 Trask
3,951,416 A * 4/1976 Koch et al. ..... 473/212
4,023,812 A 5/1977 Lorang
5,330,189 A * 7/1994 Reichow ..... 473/224
5,470,073 A 11/1995 Vasquez
5,634,854 A * 6/1997 Albertsson ..... 473/213
5,743,805 A * 4/1998 Richter ..... 473/213
5,795,238 A * 8/1998 Nicholson ..... 473/214
5,846,143 A 12/1998 Brock et al.
5,868,632 A * 2/1999 Drelick ..... 473/213
5,919,097 A * 7/1999 Cole ..... 473/212
6,251,025 B1 6/2001 Brock et al.
6,350,206 B1 * 2/2002 Lambert, ll ..... 473/205
6,537,160 B2 * 3/2003 Chrystal ..... 473/422

* cited by examiner

*Primary Examiner*—Derris H. Banks
*Assistant Examiner*—Urszula M Cegielnik
(74) *Attorney, Agent, or Firm*—Robert M. Hunter

(57) ABSTRACT

A method of training a golf swing including the steps of attaching a device to the golf club that provides a multi angled guide arm which maintains the correct structure between the radial surface of the leading forearm and the hands and wrists of the golfer as they execute the new millennium rotational body swing popularized by today's leading tour professionals.

24 Claims, 4 Drawing Sheets

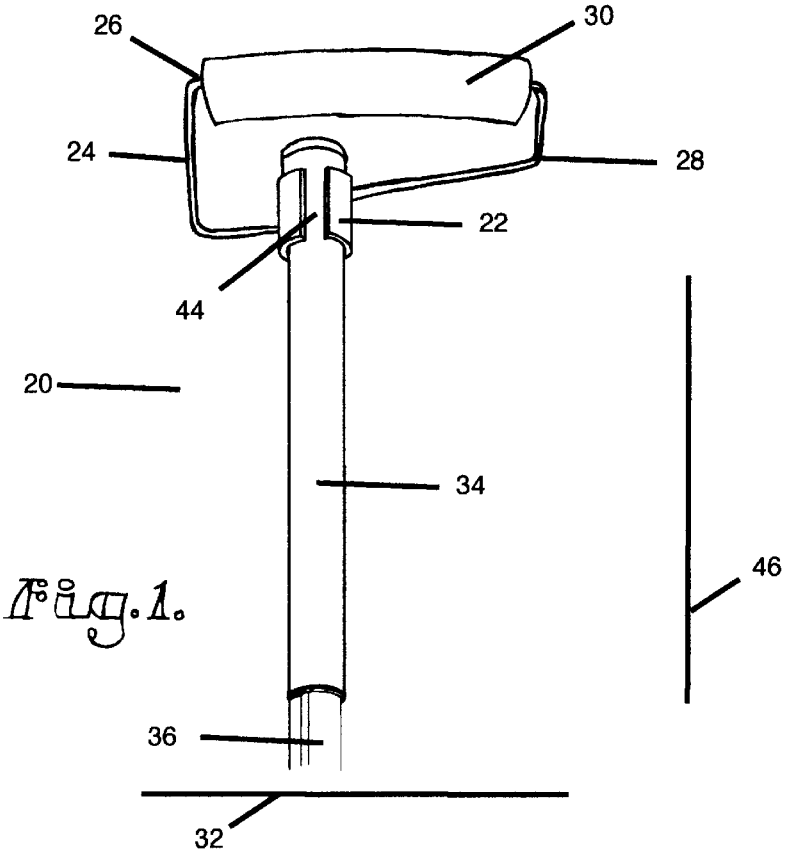
Fig. 1.
Fig. 2.
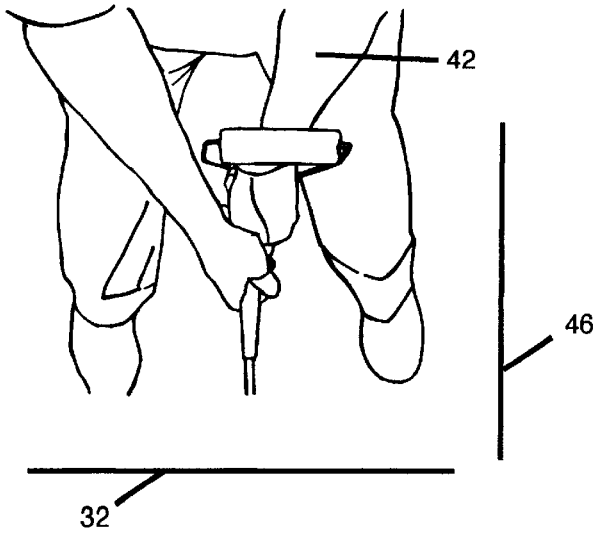
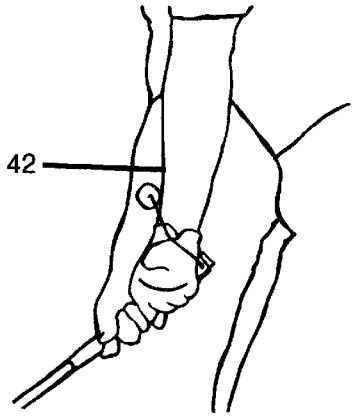
Fig. 3.

Fig.4.
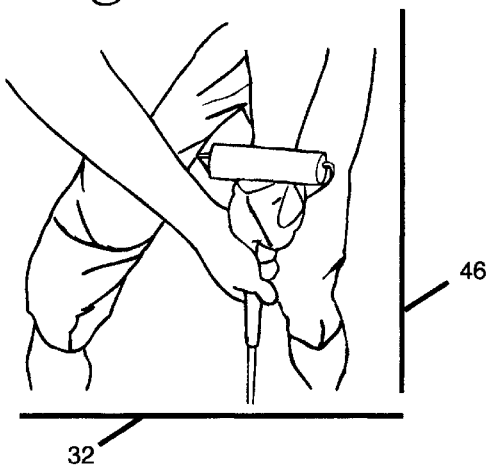
Fig.5.
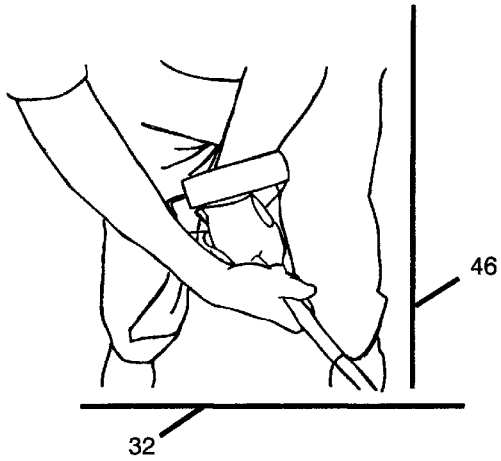
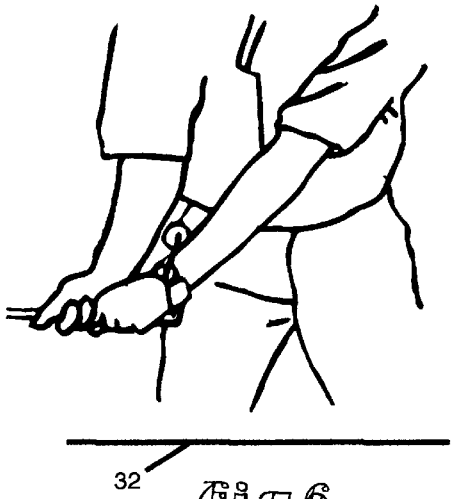
Fig.6.
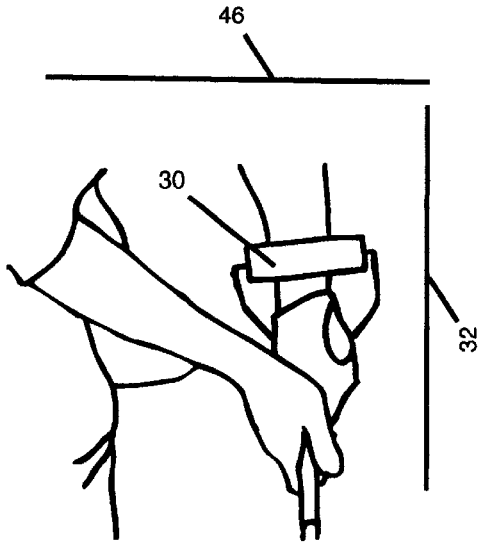
Fig.7.

GOLF WRIST TRAINER

I claim the benefit of provisional Application No. 60/297,912 dated Jun. 13, 2001.

BACKGROUND OF THE INVENTION

This invention relates to an improved method and apparatus for giving unmistakable positive and at the same time negative feedback to the user for training the movements of the body to properly execute a golf swing. And, in particular, to a method and apparatus which enables the golfer to learn the correct action of one's hands, wrists and forearms in relation to the club as it is swung in a golfing stroke in what has been called the new millennium rotational body swing.

The golf swing is a most complicated movement that is best accomplished by the interaction of the alternating contraction and relaxation of opposing muscle groups. Because this movement occurs in less than two seconds and must be coordinated to the millisecond, it cannot be controlled by conscious thought. It must be trained through the subconscious mind. Thus while in training, it is desirable that golfers have continuous information and feedback throughout the entire movement that they are maintaining the correct structure of the forearms and the hands and wrists in relation to the club as it is swung in a golfing stroke.

Many devices have been invented in hopes of giving the average golfer a pro type swing. They range from huge plastic tubing hoop type affairs along which the shaft must be swung to smaller devices that connect with the shaft and make contact with various parts of the user's body.

Examples of these types of devices include U.S. Pat. No. 5,470,073 by Vasquez. I shared a booth at the PGA show in Orlando with Mr. Vasquez about 5 years ago and enjoyed talking to him about his device. He showed me how it attaches to the putter and had means for contacting the insides of the golfer's forearms as they make a putting stroke, thereby keeping the golfer's forearms in the same relationship and structure throughout the entire putting stroke. It is a very good device for putting, but would not work in a full golf swing. U.S. Pat. No. 4,023,812 by Lorang attaches to the off-target side of the shaft of the club. A guide arm extends outwardly and upwardly towards the golfer's off target-forearm. As the club is swung backwardly, the guide will contact the off-target forearm, indicating that the wrists have been correctly cocked, and as the club is swung forwardly, the contact guide will again disengage from the golfer's forearm when the hands are about hip high in the downswing. The contact arm will stay off the golfer's forearm until it reunites at the finish of the swing. U.S. Pat. Nos. 5,846,143 and 6,251,025 by Brock are similar to Lorang. The only difference is that they have a guide arm those contacts the leading forearm of the golfer when the hands are about hip high in the backswing and relinquishes contact when the hands are about hip high in the downswing. The contact is again made when hands are about hip high on the follow thru to the finish.

The closest known prior art to the present invention is U.S. Pat. No. 3,918,721 By Trask. It has means for attaching a guide arm to the club which also makes contact with the leading forearm. The guide arm only makes contact with the leading forearm of the golfer if an incorrect movement is made during the swing. It does not contact at address or any other time during the swing if the club is swung correctly and the wrists are properly pronated throughout the swing Unfortunately, all of these past inventions have not taken into account what is called the new millennium rotational body swing. This modern golf swing is the swing used by the majority of today's best tour pros and top amateurs. The reason that this swing is the preferred motion used by the majority of the best players is that it is easier to consistently repeat and when used correctly, it enables the player to hit the ball consistently straighter. This swing focuses on using the large muscles of the body. The idea is to let the rotation of the trunk, hips and legs release the golf club correctly, with no conscious release of the wrists at all. In this swing, the golfer just needs to keep the wrists and arms quiet, passive and in the same relationship to the golf club throughout the entire swing that they were in at address.

Unfortunately, since the prior art has focused only on the old time, conventional theory of pronation of the wrists in the swing, they over involve the hands and wrists in the golf swing. They do this either by having the guide member provide no contact to the golfer's body or sporadic contact to the golfer's body. These two methods have two common drawbacks when it comes to the new millennium rotational body swing.

The first concerns the ability of the golfer to practice the swing at the same speed that they would use on the golf course while actually playing golf. Where there is only sporadic contact, the golfer won't take practice swings at full speed, because they become too concerned about matching up with the guide at some time in the backswing or follow thru. And, also when the idea is not to have any contact at all with the guide member, they become too concentrated on going slow and avoiding such contact.

The second drawback is that the prior art concentrates and puts too much emphasis on thinking about the pronation and supination of the hands and wrists in the swing. The reason that they did this is that conventional thinking suggested that the smaller muscles involved with these parts of the body dominated the swing. When in fact, the larger, more powerful muscles of the golfer's trunk dominate the movement of the club in this new, modern swing.

What is needed is a guide that will define the relationship of and stay in contact with the radial bone of the golfer's leading arm from the beginning of the swing to the finish. What is needed them is a device that provides continuous positive feedback throughout the entire swing in order to reproduce this new, modern swing. What is needed is a guide that allows the user to take full speed swings, with the same motion that they use on the golf course. And what is also needed is a device that will teach golfers to keep their hands and wrists passive and relatively uninvolved while the big muscles of their bodies take care of releasing the club through the swing.

OBJECTS OF THE INVENTION

This invention relates to an improved method and apparatus for training the movements of the body to properly execute a golfing stroke and, in particular, to a method and apparatus which enables the golfer to simulate the feeling of the today's modern swing known as the new millennium rotational body swing.

It is, therefore, the primary object of the present invention to provide a method and apparatus for training a golfer to feel what the correct structure of their hands, wrists and forearms should be in relationship to the body and the golf club during a golfing stroke that is made using the new millennium rotational body swing; as a corollary to the foregoing object, it is an important aim of this invention to provide a method and apparatus for training a golfer to minimize the conscious involvement of the hands in the golf swing since the release of the golf club with this modern swing is achieved by means of the rotation of the body, and only focusing minimal attention on the hands and wrists as the primary initiators of the correct movement of the golf club. The golfer can think of the wrist trainer, the arms, the hands and the club as one unit. The golfer simply turns this unit to the back with their large muscles and then swings this unit to the front, without any conscious use of the hands or arms in the golfing stroke.

As a corollary to the foregoing objects, it is an important aim of the present invention to provide a device that provides continuous positive feedback throughout the entire swing in order to reproduce this new, modern swing. In addition to accomplishing the foregoing, this device also defines the relationship of, and stays in contact with the radial bone of the golfers' leading arm from the beginning of the swing to the finish.

Still another important object of the invention is to develop in the practice swing the golfers' natural sense of timing, tempo, and rhythm that they use for swings on the golf course. Since there are no places in the swing where the golfer has to guide the trainer to contact the leading forearm, there will be more chance of developing a natural motion instead of a guided one. This allows the user to take full speed swings exactly the same as the motions that they use on the golf course.

Other and further objects will appear in the course of the following description of the invention. The accompanying drawings, which are incorporated in and constitute a part of this specification, illustrate possible embodiments of this invention and, together with the description, serve to explain the principles of the invention.

DESCRIPTION OF THE DRAWINGS

FIG. 1 is a perspective drawing of the first embodiment of the invention attached to the grip of a golf club, showing the details of the collar for attaching it to the grip, the multi angled guide member, and the soft foam covering the second part of the guide member.

FIG. 2 is a fragmentary view taken from above and in front of a golfer at address with the present invention mounted on the golf club and the golfer correctly positioned with the first part of the guide not touching the insides of either forearm and the second part of the guide touching the radius bone of the leading arm and also parallel to the target line.

FIG. 3 is a fragmentary view taken from a reference plane that is perpendicular to the golfer's target line and shows how the present invention attaches to the club and the golfer from that angle.

FIG. 4 is a fragmentary view taken from above and in front of a golfer at correct impact with the golf ball, where the configuration of the device is the same as at address. The first part of the guide is not touching the insides of either forearm and the second part of the guide is touching the radius bone of the leading arm and is also parallel to the target line, the same as it was at address.

FIG. 5 is a fragmentary view taken from above and in front of a golfer at incorrect impact with the golf ball, where the configuration of the device is different than at address. The first part of the guide is touching the insides of the trailing forearm and The second part of the guide is angled incorrectly from where it was at address. It can also be noted that the golfer's leading arm now is incorrectly bent at the wrist compared to FIG. 4 where a straight inline relationship is maintained between the leading arm and the club.

FIG. 6 is a fragmentary view taken from in front of the golfer with the golf club parallel to the ground in the backswing.

FIG. 7 is a fragmentary view taken from behind and above the golfer with the golf club parallel to the ground in the backswing as shown in FIG. 6

Figure 8:
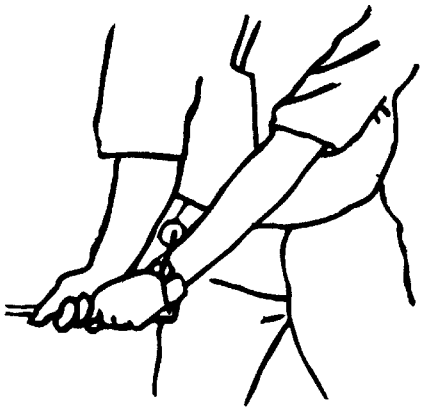
FIGS. 8–9 are fragmentary views taken from in front of the golfer showing how the device works with a chipping stroke.
Figure 9:
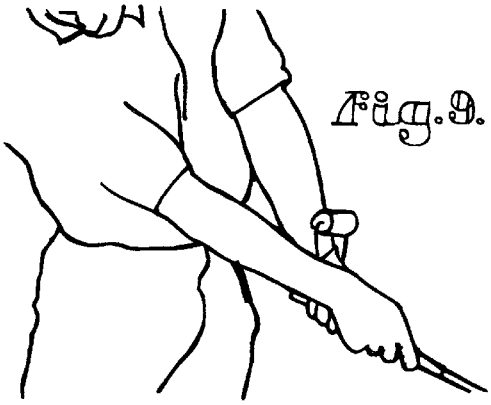
Figure 10:
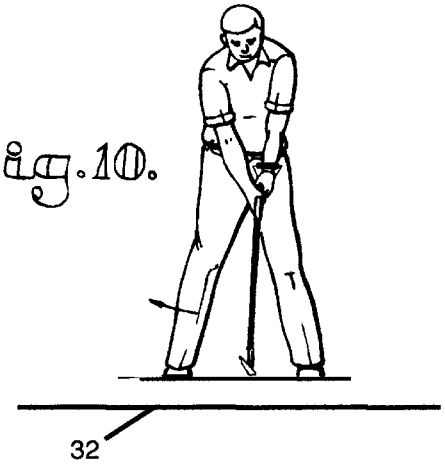
FIGS. 10–13 is views taken from in front of the golfer showing how the device works in a full swinging action.

| | |
|---|---|
| 20 | Wrist trainer golf swing training device |
| 22 | Collar for attaching to golf club |
| 24 | First part of guide member |
| 26 | Second part of guide member |
| 28 | Third part of guide member |
| 30 | Soft covering of the second part of guide member |
| 32 | Target line |
| 34 | Golf club grip |
| 36 | Golf club shaft |
| 38 | Golf club head |
| 40 | Golf club |
| 42 | Radial surface of leading arm |
| 44 | Collar slot |
| 46 | Reference plane |
| 48 | Leading edge of the shaft of the golf club |
| 50 | Second embodiment of the invention |
| 52 | First spring |
| 54 | Second spring |

DETAILED DESCRIPTION

Reference will now be made in detail to the present preferred embodiments of the invention, examples of which are illustrated in the accompanying drawings in which like reference characters refer to corresponding elements.

With reference to FIGS. 1–7, the wrist trainer apparatus of the first embodiment of the present invention is illustrated. The apparatus can be used with any golf club 40 and is attached in this case to the grip 34 of the club by means of a collar 22 which has a slot 44 in it which is at least large enough to allow the shaft 36 of a golf club 40 to pass through it unobstructed. This opening would be approximately four tenths of an inch. The collar 22 of the wrist trainer 20 is placed under the shaft 36 at its smallest diameter and pulled up to the top of the grip 34 where it rests securely. Obviously, any like attaching means that securely fastens the wrist trainer apparatus to the grip could be utilized. These would include clamping systems that consist of similar collar 22 type mechanisms that if constructed of flexible materials like plastic would include mating wings that could be tightened by a bolt and nut once it was slipped on the shaft.

The first part 24 of the guide member is connected to the collar 22 and extends upwards from the collar 22 between the inside of a golfer's forearms. It should be adjusted so that it is about a quarter inch away from touching the inside of the trailing forearm. The second part 26 of the guide member then angles forwards towards the golfer's target and rests on the radial surface of the forearm of the leading arm of the golfer 42. A flexible, soft material 30 such as foam rubber or the like covers it. The third part 28 of the guide member then angles back to the ground, and reattaches to the collar 22.

Practice with the wrist trainer 20 is illustrated by the sequence of views of FIGS. 8–13. To get to the top of the backswing in FIG. 11, normally the golfer would have to think about keeping his left arm straight and pronated, the right arm supinated and in flexion, with both wrists in radial flexion, the left wrist in palmar extension and the right wrist in extension. In order to arrive at the finish illustrated in FIG. 13, the golfer would have to think about supinating the left arm and pronating the right arm so that they would arrive with the left arm in flexion and the right arm relatively straight, with both wrists in radial flexion, the left wrist in palmar extension and the right wrist in extension. Instead of thinking about all of that, all the golfer has to do is keep the radial surface of the leading arm 42 in contact with the soft covering of the second part of the guide member 30 and avoid contacting the first part of the guide member 24 as they let the large muscles of the body turn the club through the swing.

In addition, the wrist trainer provides checkpoints throughout the swing that indicate if the golfer is on the correct plane. The first checkpoint is at FIGS. 6–7. To check if the golfer is in the correct position for this part of the swing, they would make sure that when the shaft 36 of the club 40 becomes parallel with the ground that it is also parallel to the target line 32 and that the grip 34 of the shaft 36 is generally over the toes of the right foot. The second part of the guide member 26 and its soft covering 30 is to be perpendicular to the target line 32 at this time and parallel to the reference plane 46.

Figure 11:
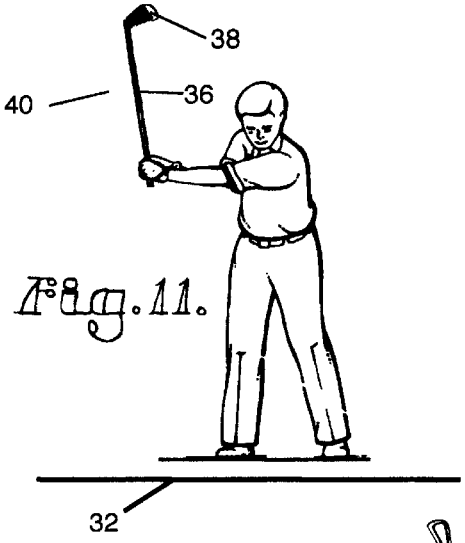
Figure 12:
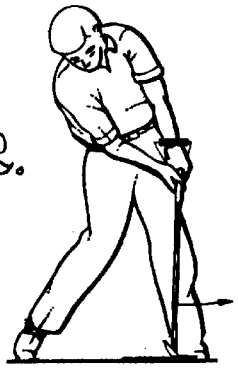
Figure 13:
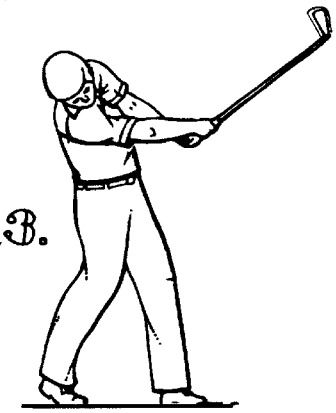
Figure 14:
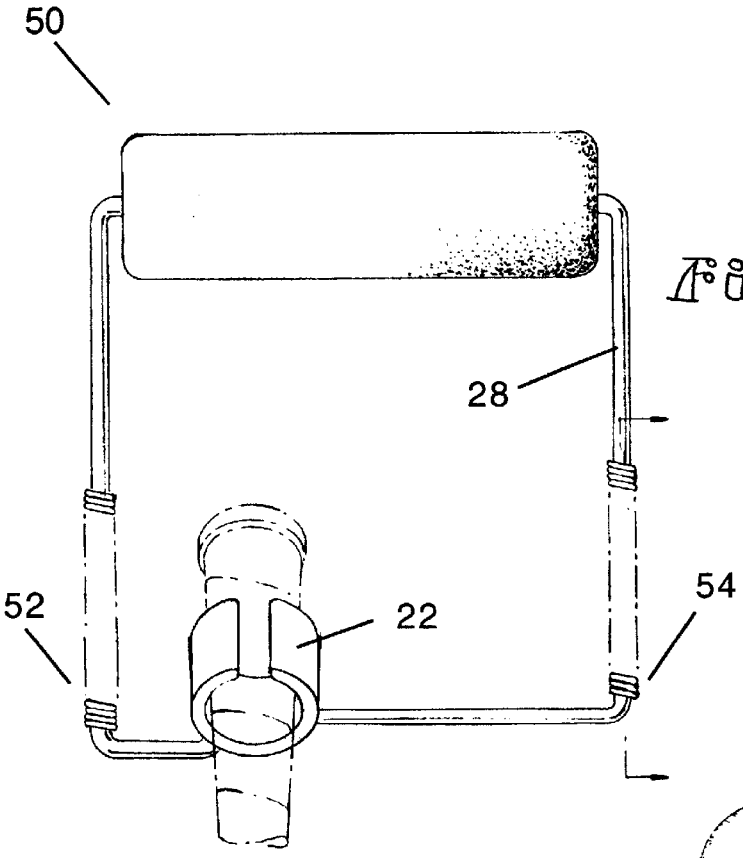
FIG. 14 is a perspective drawing of a second embodiment of the invention attached to the grip of a golf club, showing the springs.
Figure 15:
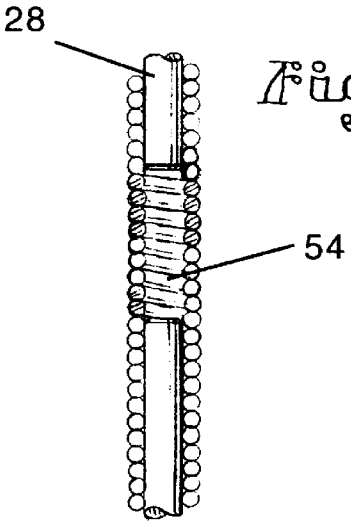
FIG. 15 is a fragmentary view showing how the springs attach to the guide members.
Figure 16:
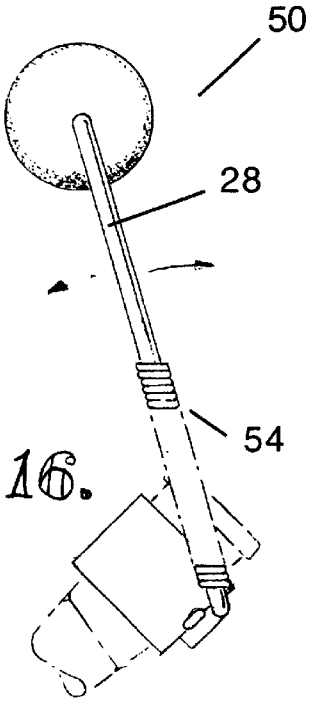
FIG. 16 is fragmentary view of the device taken from in front of the golfer showing the springs allow the guide member to rotate in the directions of the arrows.

The next checkpoint is at FIG. 11. The golfer should check that the clubshaft 36 is pointing at the target line 32. When the golfer arrives back at impact in FIG. 12 the leading arm 46 and the shaft 36 and the wrist trainer 20 should have come back into the same alignments as they were in FIG. 10, at address. The swing would then continue to FIG. 13 where the shaft 36 would again be parallel to the target line 32. In addition, the second part 26 of the wrist trainer 20 and its soft covering 30 would be perpendicular to the target line 32 at this time, with the grip 34 of the shaft 36 generally over the toes of the left foot.

Any deviation from any of these checkpoints would indicate that the golfer would have to adjust his bodily movements to effect these simple corrections in order to get the swing onto the proper plane and correct release as exhibited by the touring professionals who use the new millennium rotational swing.

Thus we can see that this wrist trainer 20 provides the golfer with unmistakable positive and negative feedback, as to the correct motions and muscular feelings that must be made in order for his hands, wrists and forearms to be in the proper structure throughout the whole swing in order to effect what is popularly known as the new millennium rotational swing. This will allow both inexperienced through scratch golfers to improve their ball striking abilities.

It should be apparent that instead of providing a multi angled guide member that is preferably removable it may be desirable to mount a guide member permanently on the golf club, or alternatively to produce a training club with the guide member integrated into it. It should also be apparent that this could help any game where a participant is involved with an implement used to strike a ball. It is also apparent that various sizes should be available to accommodate the difference in the hands and wrists of men and women and children.

The wrist trainer could be constructed of stainless steel in order to give the invention strength and flexibility. Any other material, such as injection molded plastic would also work, or a combination of stainless steel and plastic.

A second embodiment 50 would be to provide the multi angled guide member with springs 54 or mechanical joints at the flexure points to more readily allow the angle to go from 135 degrees to 90 degrees.

The preferred embodiment of the device would combine the second embodiment with clamping means consisting of clamp wings extending downward from the collar and by using a bolt and wing nut type arrangement to attach it to the grip.

From the foregoing, it will be seen that this invention is one well adapted to attain all of the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

As many possible embodiments can be made of this invention without departing from the scope thereof, it is to be understood that all matter herein set forth or shown in the accompanying drawings is to be interpreted as illustrative and not is a limiting sense.

What is claimed is:

1. A golf wrist trainer for training a golfer in the execution of a swing of a golf club, said golf club having a shaft with a longitudinal axis, a leading edge and a grip, said golf wrist trainer comprising:

an attachment means for attaching said golf wrist trainer to said grip adjacent the top end of said grip; and a guide member, said guide member comprising a first part, said first part having a first segment that is attached to and extends away from said attachment means in a first direction and generally lies in a first plane that is perpendicular to a second plane passing through said leading edge and a second segment that generally lies in a third plane that is parallel to said second plane passing through said leading edge, a second part having two ends, one of which is attached to said second segment, said second part lying in a fourth plane that is generally perpendicular to said longitudinal axis, and a third part, said third part having a first portion that is attached to and extends away from said attaching means in a second direction that is substantially opposite said first direction and generally lies is a fifth plane that is perpendicular to the second plane passing through said leading edge and a second portion that generally lies in a sixth plane that is parallel to said second plane passing through said leading edge, said second portion being connected to the other end of said second part and generally lying in a seventh plane that contains said second segment.

2. A golf wrist trainer for training a golfer in the execution of a swing of a golf club, said golf club having a shaft with a longitudinal axis, a leading edge and a grip, said golf wrist trainer comprising:

an attaching means for attaching said golf wrist trainer to said grip, adjacent the top end of said grip; and a guide member, said guide member comprising a first part, said first part having a first segment that is attached to and extends away from said attaching means in a first direction and a second segment that generally lies in a first plane that is parallel to a second plane that passes through said leading edge, a second part having two ends, one of which ends is attached to said second segment, said second part lying in a second plane that is generally perpendicular to said longitudinal axis, and a third part, said third part having a first portion that is attached to and extends away from said attaching means in a second direction and a second portion that generally lies in a third plane that is parallel to said second plane that passes through said leading edge, said second portion being connected to the other end of said second part.

3. The golf wrist trainer of claim 2 wherein the second part is covered with a flexible, soft material.

4. The golf wrist trainer of claim 2 wherein the second segment comprises a first flexible zone and wherein said second portion comprising a second flexible zone.

5. The golf wrist trainer of claim 4 wherein said first flexible zone comprises a first spring and said second flexible zone comprises a second spring.

6. A golf club comprising a clubhead and the golf wrist trainer of claim 2.

7. A set of golf clubs comprising the golf club of claim 6.

8. A golf wrist trainer for training a golfer in the execution of a swing of a golf club, said golf club having a shaft with a longitudinal axis and a grip on said shaft, said golf wrist trainer comprising:

an attaching means for securing said golf wrist trainer to said grip; and a guide member, said guide member comprising a first part, said first part having a first segment and a second segment, said first segment being attached to and extending away from said attaching means, a second part that is attached to said second segment, said second part lying in a plane that is perpendicular to said longitudinal axis, and a third part, said third part having a first portion and a second portion, said first portion being attached to and extending away from said attaching means and said second portion being attached to said second part.

9. The golf wrist trainer of claim 8 wherein the second part is covered with a soft material.

10. The golf wrist trainer of claim 8 wherein the second segment comprises a first flexible zone and wherein said second portion comprising a second flexible zone.

11. The golf wrist trainer of claim 10 wherein said first flexible zone comprises a first spring and said second flexible zone comprises a second spring.

12. A golf club comprising a clubhead and the golf wrist trainer of claim 11.

13. A set of golf clubs comprising the golf club of claim 12.

14. A trainer for training a golfer having a leading arm with a radius covered by skin and a trailing arm in the use of a golf club having a shaft with a longitudinal axis and a grip, said trainer comprising:

means for attaching said trainer to the grip of the golf club; and a guide arm connected to said means for attaching, said guide arm comprising means for providing said golfer with feedback on the correct positions of said leading arm and said trailing arm relative to said golf club during said use, means for contacting the skin over said radius during said use, and means for limiting the angle between the radius and said shaft during said use.

15. The trainer of claim 14 wherein said means for providing comprises a first part, said first part having a first segment and a second segment, said first segment being attached to and extending away from said means for attaching.

16. The trainer of claim 14 wherein said means for contacting comprises a second part that is attached to said second segment, said second part lying in a plane that is perpendicular to said longitudinal axis.

17. The trainer of claim 14 wherein said means for limiting comprises a third part, said third part having a first portion and a second portion, said first portion being attached to and extending away from said means for attaching and said second portion being attached to said means for contacting.

18. The trainer of claim 14 wherein said means for limiting is operative to limit the angle between the radius and said shaft from approximately 135 degrees to approximately 90 degrees during said use.

19. The golf club of claim 12 wherein said golf club is selected from the group consisting of:

an iron, and a driver, and a putter.

20. A method for training a golfer to execute a proper swing of a golf club having a shaft with a longitudinal axis and a grip on said shaft using a golf wrist trainer comprising an attachment means for attaching said golf wrist trainer to said grip and a guide member, said guide member comprising a first part, said first part having a first segment and a second segment, said first segment being attached to and extending away from said an attachment means, a second part that is attached to said second segment, said second part lying in a plane that is perpendicular to said longitudinal axis, and a third part, said third part having a first portion and a second portion, said first portion being attached to and extending away from said attachment means and said second portion being attached to said second part, said method comprising:

addressing a ball, at which time said second part is oriented parallel to a line to a target;

executing a first part of a backswing to a first checkpoint at point time said shaft is parallel to the ground and parallel to a line to said target line, said handle is generally over the toes of the right foot of the golfer, and said second part is oriented perpendicular to said target line;

continuing the backswing to a second checkpoint at which point the said shaft is pointing at the target line;

executing a forward swing to a third checkpoint at which point said second part is oriented parallel to said target line; and continuing the forward swing to a fourth checkpoint at which point said shaft and said second part are oriented parallel to said target line and said grip is generally over the toes of the left foot of the golfer.

21. The method claim 20 wherein addressing the ball comprises orienting the second part so that it is parallel to a reference plane of a zero degree clubface.

22. The method claim 20 in which impact with a golf ball occurs at the third checkpoint.

23. The method claim 20 further comprising having an observer report to the golfer the orientation of the second part at each checkpoint after the swing is completed.

24. A method for training a golfer to execute a proper swing of a golf club having the golf wrist trainer of claim 1 attached to it, said method comprising:

addressing a ball, at which time said second part is oriented parallel to a line to a target;

executing a first part of a backswing to a first checkpoint at point time said shaft is parallel to the ground and parallel to a line to said target line, said handle is generally over the toes of the right foot of the golfer, and said second part is oriented perpendicular to said target line;

continuing the backswing to a second checkpoint at which point the said shaft is pointing at the target line;

executing a forward swing to a third checkpoint at which point said second part is oriented parallel to said target line; and continuing the forward swing to a fourth checkpoint at which point said shaft and said second part are oriented parallel to said target line and said grip is generally over the toes of the left foot of the golfer.

* * * * *